US008103203B2

(12) United States Patent
Nagai et al.

(10) Patent No.: US 8,103,203 B2
(45) Date of Patent: Jan. 24, 2012

(54) FIXING DEVICE AND IMAGE FORMING APPARATUS

(75) Inventors: Yoshiyuki Nagai, Shiojiri (JP); Kenjiro Yoshioka, Shiojiri (JP); Katsuhito Gomi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 102 days.

(21) Appl. No.: 12/549,203

(22) Filed: Aug. 27, 2009

(65) Prior Publication Data

US 2010/0054787 A1 Mar. 4, 2010

(30) Foreign Application Priority Data

Aug. 28, 2008 (JP) ..... 2008-218997

(51) Int. Cl.
*G03G 15/20* (2006.01)

(52) U.S. Cl. ..... 399/333; 399/122; 219/216

(58) Field of Classification Search ..... 399/33, 399/67, 69, 122, 320, 328, 330–334; 219/216
See application file for complete search history.

(56) References Cited

U.S. PATENT DOCUMENTS

| | | | | |
|---|---|---|---|---|
| 4,223,203 | A * | 9/1980 | Elter | 219/216 |
| 2005/0047836 | A1 * | 3/2005 | Kellie et al. | 399/328 |
| 2005/0276624 | A1 * | 12/2005 | Fujino | 399/69 |
| 2007/0122173 | A1 * | 5/2007 | Mitsuoka et al. | 399/69 |

FOREIGN PATENT DOCUMENTS

JP 2002-365967 12/2002

* cited by examiner

*Primary Examiner* — David Porta
*Assistant Examiner* — Benjamin Schmitt
(74) *Attorney, Agent, or Firm* — DLA Piper LLP (US)

(57) ABSTRACT

A fixing device that includes a first fixing unit including a first heating roller having a metallic roller and a resin layer formed on the metallic roller, and a first pressure roller coming into abutment with the first heating roller; and a second fixing unit having a second heating roller being configured to heat a transfer material heated by the first fixing unit and including a metallic roller, a elastic layer formed on the metallic roller, and a resin layer formed on the elastic layer, and a second pressure roller coming into abutment with the second heating roller is provided.

6 Claims, 8 Drawing Sheets

FIXING DEVICE AND IMAGE FORMING APPARATUS

CROSS-REFERENCE TO RELATED APPLICATIONS

This application claims the benefit of priority under 35 USC 119 of Japanese application no. 2008-218997, filed on Aug. 28, 2008, which is incorporated herein by reference.

BACKGROUND

1. Technical Field

The present invention relates to a fixing device and an image forming apparatus in which deterioration of image quality is restrained in an electrophotographic system which employs a liquid developer.

2. Related Art

In an electrophotographic type image forming apparatus, a fixing device with respect to a transfer material is used. In the fixing device as described above, a heating roller and a pressure roller constitute a fixing roller pair, and a nip portion is formed at a position at which the heating roller and the pressure roller come into abutment with each other. The heating roller is provided with an electric heating unit such as a heater lamp. A recording medium (transfer material) such as a recording paper is allowed to pass through the nip portion while being heated and pressurized, so that fixation is achieved.

JP-A-2002-365967 discloses an image forming apparatus having two or more fixing roller pairs disposed along the direction of transport of the recording medium. Referring to FIG. 1 in JP-A-2002-365967, a first fixing unit A is provided on the upstream side in terms of the direction of transport of a transfer material P, and a second fixing unit B on the downstream side. A fixing roller 1 employed as a heating member in the first fixing unit A is provided with a elastic layer 12 formed of silicon rubber on a core metal 11 formed of aluminum, and a mold release layer 13 formed of PFA (tetrafluoroethylene-perfluoroalkyl vinyl ether copolymer) on the elastic layer 12. Also, a fixing roller 3 employed as a heating member in the second fixing unit B is provided with a elastic layer 32 formed of silicon rubber on a core metal 31 formed of aluminum. A mold release layer 33 is formed of PFA on the elastic layer 32.

In this type of image forming apparatus, a configuration employing a liquid developer is known. FIG. 8 is an explanatory drawing showing toner formed on the surface of the transfer material when the transfer material is in an unfixed state in schematic form in an example of the image forming apparatus employing the liquid developer. In FIG. 8, reference numeral 97 designates a transfer material, reference numeral 75 designates a carrier, and reference numeral 76 designates a solid content.

FIGS. 9A to 9D are explanatory drawings showing a state of the toner formed on the surface of the transfer material in the related art as disclosed in JP-A-2002-365967. In the configuration in the related art, the heating rollers provided in a plurality of stages each include a elastic layer provided on a core metal and a mold release layer formed on the elastic layer. FIGS. 9A and 9B show states of the toner in the first fixing unit on the upstream side in terms of the direction of transport of the transfer material. A heating roller 83*x* is formed of a elastic material. FIG. 9A shows a state in which aggregation of the melted solid content 76 is insufficient. FIG. 9B shows a state in which the melted solid content 76 has started to aggregate, but the carrier 75 and the melted solid content 76 are mixed and hence the solid content 76 cannot be liquidized.

FIG. 9C shows a state of the toner in a second fixing unit. In FIG. 9C, aggregation of the solid content 76 which is further melted from the state shown in FIG. 9B is increased, but liquidization of the solid content 76 is still insufficient. FIG. 9D shows a state of the toner after the fixation in the second fixing unit. In this example, since layer separation between the carrier 75 and the melted solid content 76 is insufficient, the state of a film of the toner formed on the surface of the transfer material is not good, and a shape different from the shape of the surface of the transfer material is assumed.

In this manner, in the configuration of the heating roller described in JP-A-2002-365967, when the liquid developer is used in the image forming apparatus, a film is formed with the carrier remaining in the toner solid content at the time of heating in the fixing device. Therefore, there is a problem that the gloss of a part where the solid content exists is significantly different from the original gloss of the transfer material, and hence a low quality image is formed.

SUMMARY

An advantage of the invention is that a fixing device and an image forming apparatus, in which the gloss difference between a toner film and a transfer material is reduced, improves the quality of images when performing fixation on the transfer material on which the toner film is formed.

According to a first aspect of the invention, there is provided a fixing device that includes a first fixing unit including a first heating roller having a metallic roller and a resin layer formed on the metallic roller, and a first pressure roller coming into abutment with the first heating roller; and a second fixing unit having a second heating roller being configured to heat a transfer material heated by the first fixing unit and including a metallic roller, a elastic layer formed on the metallic roller, and a resin layer formed on the elastic layer, and a second pressure roller coming into abutment with the second heating roller.

The fixing device according to the first aspect of the invention preferably includes a first temperature sensing unit coming into contact with the first heating roller; and a second temperature sensing unit disposed so as to be out of contact with the second heating roller.

Preferably, the first temperature sensing unit is provided on the downstream side of an abutting portion between the first heating roller and the first pressure roller in terms of the direction of transport of the transfer material, and the second temperature sensing unit is provided on the downstream side of an abutting portion between the second heating roller and the second pressure roller in terms of the direction of transport of the transfer material.

Preferably, the first temperature sensing unit is provided at or near an axial center of the first heating roller, and the second temperature sensing unit is provided at or near an axial center of the second heating roller.

The fixing device according to the first aspect of the invention preferably includes a first heat source disposed in the first heating roller; a second heat source disposed in the second heating roller; and a temperature control unit configured to control the temperatures of the first heat source and the second heat source on the basis of information sensed by the first temperature sensing unit and information sensed by the second temperature sensing unit.

According to a second aspect of the invention, there is provided an image forming apparatus that includes an image carrier; an exposure unit configured to form a latent image on the image carrier; a developing unit configured to develop the latent image formed by the exposure unit; a transfer member to which an image developed on the image carrier is transferred; a transfer unit configured to transfer the image transferred on the transfer member to the transfer material; a first fixing unit including a first heating roller having a metallic roller and a resin layer formed on the metallic roller and a first pressure roller coming into abutment with the first heating roller; and a second fixing unit having a second heating roller being configured to heat a transfer material heated by the first fixing unit and including a metallic roller, a elastic layer formed on the metallic roller, and a resin layer formed on the elastic layer, and a second pressure roller coming into abutment with the second heating roller.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 6:
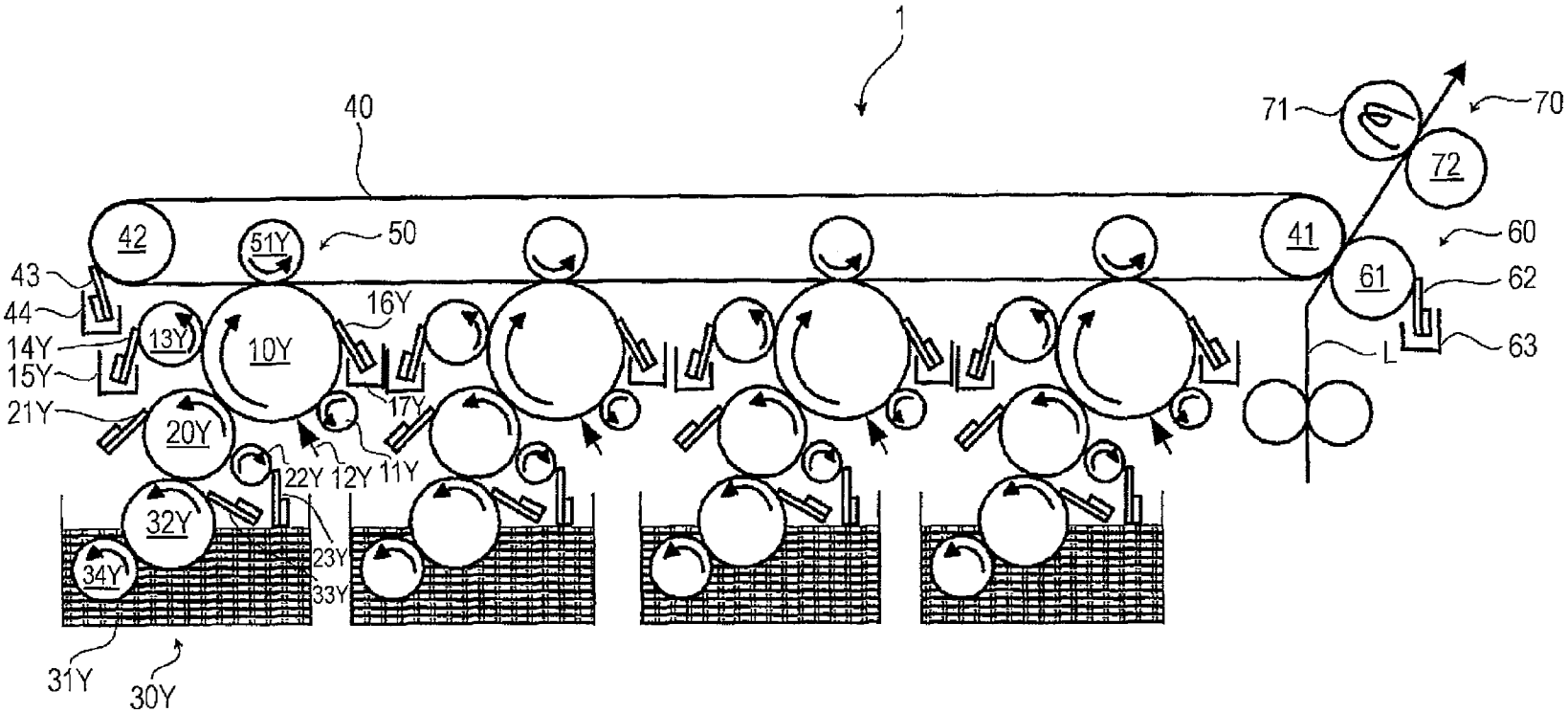
FIG. 6 is a schematic cross-sectional view showing a general configuration of a first example of an image forming apparatus using an electrophotographic process according to the embodiment of the invention.
Figure 7:
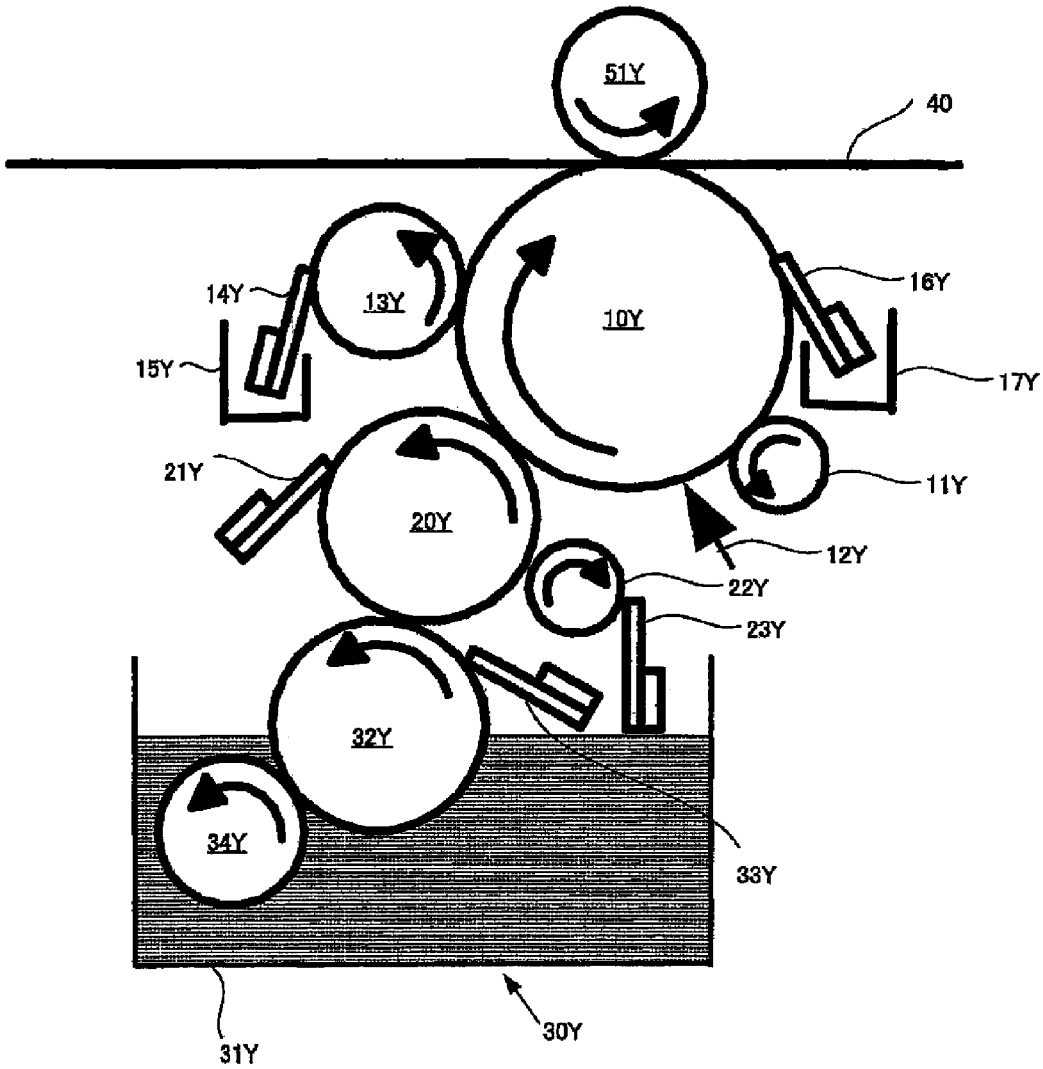
FIG. 7 is a partly enlarged cross-sectional view of FIG. 6.
Figure 8:
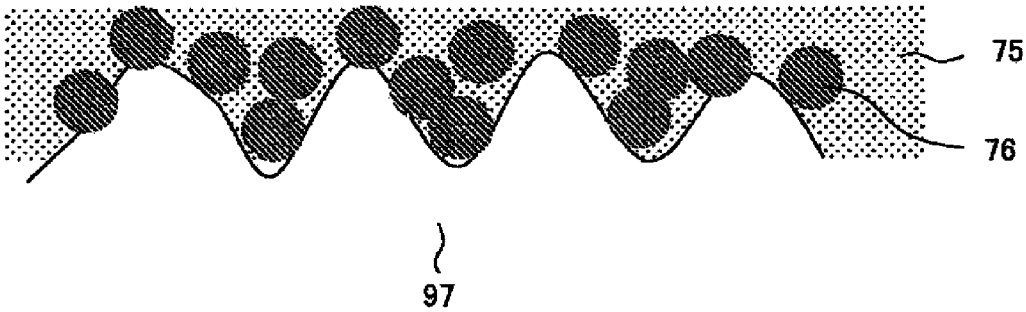
FIG. 8 Prior Art
FIG. 8 is an explanatory drawing showing a toner film formed on a surface of a transfer material.
Figure 9A:
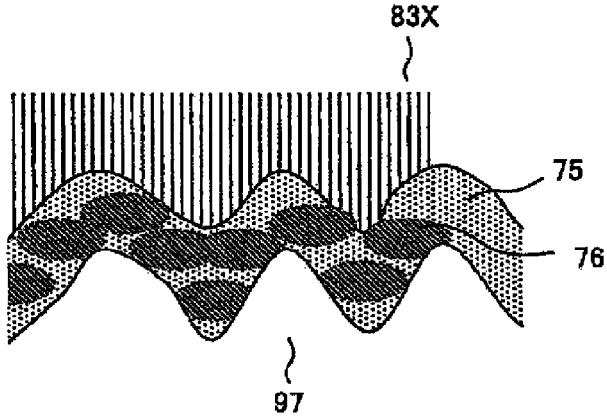
FIG. 9A Prior Art
FIGS. 9A to 9D are explanatory drawings showing a related art.
Figure 9B:
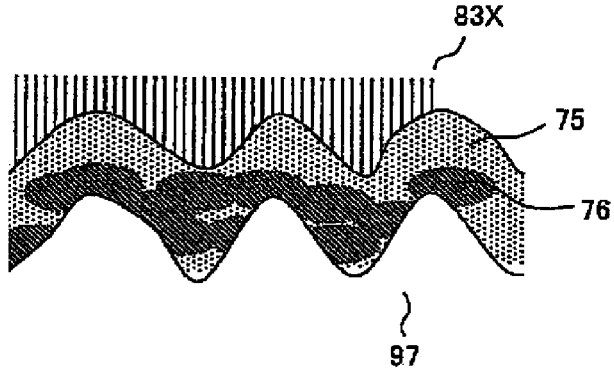
FIG. 9B Prior Art
Figure 9C:
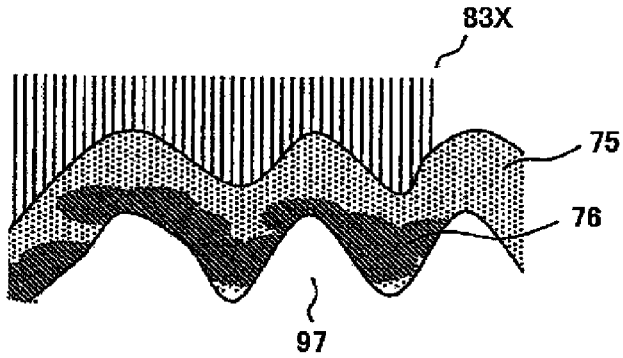
FIG. 9C Prior Art
Figure 9D:
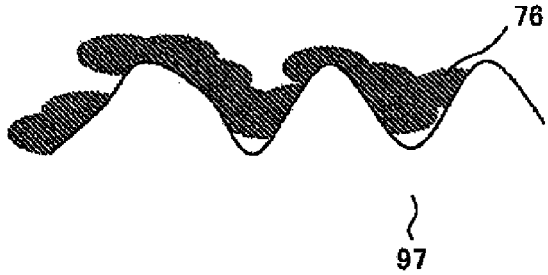
FIG. 9D Prior Art

Referring to the drawings, embodiments of the invention are described. FIG. 6 is a cross-sectional view showing principal components which constitute an image forming apparatus according to an embodiment of the invention in schematic form. FIG. 7 is cross-sectional view showing components for each color in the image forming apparatus. In FIG. 6, the same components for respective colors of yellow (Y), magenta (M), cyan (C) and black (K) are designated by the same reference numerals with suffixes of Y, M, C, and K which indicate the respective colors. FIG. 7 is a configuration for yellow (Y) from among the components shown in FIG. 6. Referring to FIG. 6 and FIG. 7, the image forming apparatus is described.

An image forming apparatus 1 includes a cleaning device having a cleaning blade 16Y and a developer collecting unit 17Y for an image carrier, a charging roller 11Y, an exposure unit 12Y, a developing roller 20Y as an example of a developer carrier of a developer unit 30Y, an image carrier squeezing roller 13Y and a cleaning device being an associated configuration of the image carrier squeezing roller 13Y and having a cleaning blade 14Y and a developer collecting unit 15Y arranged along the direction of rotation (direction of movement) of an outer periphery of an image carrier 10Y.

The developing unit 30Y includes a cleaning blade 21Y, a developer feeding roller 32Y using an anilox roller as an example of a developer feeding member, a restriction blade 33Y configured to control the developer feeding amount, a developer compressing roller 22Y and a cleaning blade 23Y configured to scrape and remove the developer on the surface thereof arranged on an outer periphery of the developing roller 20, and a developer stirring roller 34Y configured to stir the developer in a uniformly dispersed state arranged in a developer container (reservoir) 31Y having a liquid developer stored therein.

A primary transfer roller 51Y of a primary transfer unit 50Y is arranged at a position opposing the image carrier 10Y with the intermediary of an intermediate transfer member 40, and further the primary transfer unit 50Y (M, C, K) of respective colors is arranged on the downstream side in terms of the direction of movement along the intermediate transfer member 40. A secondary transfer unit 60 is arranged on the downstream side of the primary transfer unit 50Y (M, C, K), where an image is transferred to the transfer material. A fixing unit 70 is arranged on the downstream side of a sheet material transporting path L from the secondary transfer unit 60.

The liquid developer stored in the developer container 31Y includes resin fine particles as developer solid content including a pigment component, a dispersing agent, and a carrier oil as a non-volatile liquid carrier. The liquid developer is highly viscous (on the order of 30 to 10000 Pa·s). The liquid developer is obtained by adding a solid material of 1 μm in average particle diameter including a coloring agent such as pigment dispersed in thermoplastic resin into a liquid solvent such as an organic solvent, silicon oil, mineral oil, or edible oil together with the dispersing agent to have a toner solid content density of about 25%.

The liquid developer stored in the developer container 31Y is a developer in a uniformly dispersed state. The liquid developer is obtained by adding a developer or a carrier dispersed at a high density on the order of 35 to 55% in a toner weight ratio respectively to the developer container 31Y according to the developer density which varies with development on the image carrier and stirring the same by the developer stirring roller 34Y and by dispersing 25% of toner into 75% of carrier in substantial weight ratio.

In an image forming unit and the developer unit 30Y, the image carrier 10Y is uniformly charged by the charging roller 11Y, irradiated with a laser beam modulated on the basis of an inputted image signal by the exposure unit 12Y having an optical system such as a semiconductor laser, a polygon mirror, F-θ lens or the like to form an electrostatic latent image on the charged image carrier 10Y. Then, the electrostatic latent image formed on the image carrier 10Y is developed by supplying the developer from the developer feeding roller 32Y to the developing roller 20Y while controlling the amount of the supplied developer from the developer container 31Y where the liquid developer in respective colors (yellow here) is stored by the restriction blade 33Y.

The intermediate transfer member 40 is an endless elastic belt member, which is wound between a belt drive roller 41 and a tension roller 42, and is rotated by the belt drive roller 41 while coming into abutment with the image carriers 10Y, 10M, 10C, and 10K at the primary transfer units 50Y, 50M, 50C, and 50K. In the primary transfer units 50Y, 50M, 50C, and 50K, primary transfer rollers 51Y, 51M, 51C, and 51K are arranged so as to oppose the image carriers 10Y, 10M, 10C, and 10K with the intermediary of the intermediate transfer member 40. Toner images of the respective colors on the developed image carriers 10Y, 10M, 10C, and 10K are transferred on the intermediate transfer member 40 in sequence to form a full color toner image at the abutment positions with respect to the image carriers 10Y, 10M, 10C, and 10K as transfer positions.

The toner images formed on a plurality of the image carriers (photoconductors) 10Y, 10M, 10C, and 10K as described above are primarily transferred in sequence on the intermediate transfer member 40 and are carried in a superimposed manner, and are secondarily transferred to a sheet material in a lump. Therefore, for transferring the toner image on the sheet material in the secondary transfer process, the elastic belt member is employed as a means for improving secondary transferring characteristics along the surface of the non-smooth sheet material even though the surface of the sheet material is not smooth due to the fiber quality thereof.

In the secondary transfer unit 60, a secondary transfer roller 61 which is opposed to the belt drive roller 41 with the intermediary of the intermediate transfer member 40, and a cleaning blade 62 of the secondary transfer roller and a cleaning device including a developer collecting unit 63 are arranged. In the secondary transfer unit 60, a sheet member such as a sheet, a film, or a cloth is transported and supplied in the sheet material transporting path L and a single color toner image or the full color toner image is secondarily transferred to the sheet material at a timing when the full color toner image or the single color toner image formed by overlapping colors on the intermediate transfer member 40 reaches the transfer position of the secondary transfer unit 60.

On the downstream of the seat material transporting path L, the fixing unit 70 having a heating roller 71 and a pressure roller 72 opposed to each other with the intermediary of the sheet material transporting path L is arranged, so that the single color toner image or the full color toner image transferred on the sheet material is fused and fixed on a recording media (sheet material) such as a sheet, and final image formation on the sheet material is ended. The secondary transfer roller 61 is also configured with a elastic roller coated with a elastic member on the surface thereof as a means for improving the secondary transferring characteristics along the surface of the non-smooth sheet material even though the surface is the sheet material which is not smooth due to the fiber quality thereof. This is the same objective as the elastic belt member employed for the intermediate transfer member 40 which carries the toner images formed on a plurality of the image carriers 10Y, 10M, 10C, and 10K by being primarily transferred thereto and overlapped with respect to each other thereon in sequence and secondarily transfers the same to the sheet member in a lump.

A cleaning device including a cleaning blade 43 which comes into abutment with the intermediate transfer member 40, and a developer collecting unit 44 configured to collect the developer cleaned by the cleaning blade 43 is arranged along the outer periphery on the side of the tension roller 42 on which the intermediate transfer member 40 is wound together with the belt drive roller 41 in a tensed manner. The intermediate transfer member 40 after having passed the secondary transfer unit 60 is subjected to the cleaning thereon by the cleaning blade 43, and proceeds again to a primary transfer unit 50.

In the developer container 31Y, toner particles in the liquid developer have a positive charge, and the developer is stirred by the developer stirring roller 34Y to assume the uniformly dispersed state, is sucked from the developer container 31Y by the rotation of the developer feeding roller 32Y, and is supplied to the developing roller 20Y while the amount is controlled by the restriction blade 33Y.

A developer collecting unit is described. In the image forming apparatus in the embodiment, the developer is scraped and collected by the cleaning device of the developer collecting unit. The developer collecting unit includes a developing roller cleaning device 21 configured to clean a developing roller 20, a developer compressing roller cleaning device 23 configured to clean a developer compressing roller 22, image carrier squeezing devices 13 to 15, image carrier cleaning devices 16 and 17, the intermediate transfer member cleaning devices 43 and 44, and the secondary transfer roller cleaning devices 62 and 63.

The developer unit 30Y includes the cleaning blade 23Y as an example of a developer compressing roller cleaning device configured to clean the developer compressing roller 22Y which brings the toner of the liquid developer carried on the developing roller 20Y into a compressed state and the cleaning blade 21Y as an example of a developer roller cleaning device configured to clean the developing roller 20Y. The cleaning blade 21Y, being arranged on the downstream side of a developing nip portion where the developing roller 20Y comes into abutment with the image carrier 10Y in terms of the direction of rotation of the developing roller 20Y and scrapes the developer remaining on the developing roller 20Y, and the cleaning blade 23Y rotates in the direction indicated by an arrow in the drawing to scrape and remove the developer on the developer compressing roller 22Y, and causes the same to join (merge) the developer in the reservoir 31Y for reuse. The carrier and the toner to be joined here are not in a state of being mixed in color. The collected developer may be discarded.

The image carrier squeezing device is arranged on the downstream side of the developing roller 20Y in terms of the direction of rotation so as to oppose the image carrier 10Y. The image carrier squeezing device includes the image carrier squeezing roller 13Y, the cleaning blade 14Y configured to clean the surface by coming into pressing and sliding contact with the image carrier squeezing roller 13Y, and the developer collecting unit 15Y. In this configuration, the image carrier squeezing device has a function to collect excessive carrier and fogging toner which is originally unnecessary from the developer developed on the image carrier 10Y to improve the toner particle ratio in a visible image.

In this embodiment, the image carrier squeezing roller 13Y is rotated together with the image carrier 10Y at a substantially same peripheral velocity, the excessive carrier of about 5 to 10% in weight ratio from the developer developed on the image carrier 10Y is collected, so that rotational drive loads of both the rollers are alleviated and a disturbance effect of the image carrier 10Y to the visible toner image is restrained. The excessive carrier and the unnecessary fogging toner collected by the image carrier squeezing roller 13Y are collected from the image carrier squeezing roller 13Y by the developer collecting unit 15Y by an action of the cleaning blade 14Y. Since the collected excessive carrier and the fogging toner are collected from the specific isolated image carrier 10Y, the color mixing phenomenon does not occur in the image forming units of the respective colors.

In the primary transfer unit SOY, driving loads of the rotation and the movement are alleviated and the disturbing action of the image carrier 10Y to the visible toner image is restrained by the image carrier 10Y and the intermediate transfer member 40 moving at a constant speed and transferring the developer image developed on the image carrier 10Y to the intermediate transfer member 40 by the primary transfer roller 51Y. At the primary transfer unit 50Y which is the first color, the color mixing phenomenon does not occur because it is the initial primary transfer. However, from the second color onward, the toner image of a different color is transferred to a position where the toner image already primarily transferred exists to overlap the color.

Therefore, the reversely transferred toner which is reversely transferred by the reverse transfer phenomenon in which the toner is transferred from the intermediate transfer member 40 to the image carrier 10Y (M, C, K) and the remaining toner failed in transfer are mixed in color and are carried and moved on the image carrier 10Y (M, C, K) together with the excessive carrier, and are collected in the developer collecting unit 17Y (M, C, K) from the image carrier 10Y (M, C, K) by the action of the cleaning blade 16Y (M, C, K) as an example of the image carrier cleaning device.

There is a case where the unnecessary toner image on the intermediate transfer member 40 comes into contact with and is transferred to the secondary transfer roller 61 and causes the contamination of the back surface of the sheet material. For the disposal of the unnecessary toner image, a cleaning of the surface of the intermediate transfer member 40 by the cleaning blade 43, and a cleaning of the secondary transfer roller 61 by the cleaning blade 62 of the secondary transfer roller are carried out. In this manner, the cleaning blade 62 of the secondary transfer roller is provided as a device for removing the developer (toner dispersed in the carrier) transferred to the secondary transfer roller 61 and collects the developer from the secondary transfer roller 61.

Figure 1:
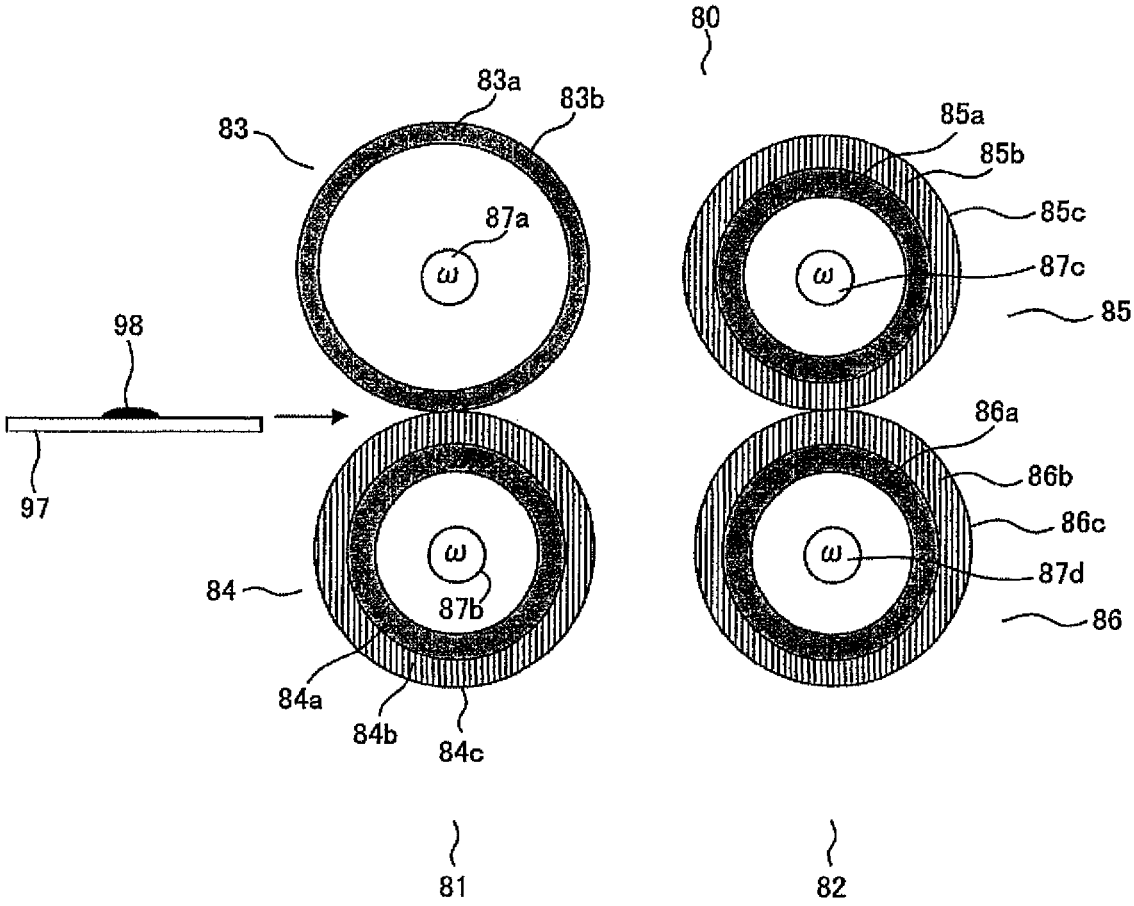
FIG. 1 is an explanatory drawing showing an embodiment of the invention.

FIG. 1 is an explanatory drawing showing a fixing device 80 according to the embodiment of the invention. The fixing device 80 is used in the image forming apparatus shown in FIGS. 6 and 7, and is provided at a position corresponding to the fixing unit 70 in FIG. 6. In FIG. 1, reference numeral 81 designates a first fixing unit provided on the upstream side in terms of the direction of transport of the transfer material 97, and reference numeral 82 designates a second fixing unit provided on the downstream side in terms of the direction of transport. The distance between the first fixing unit 81 and the second fixing unit 82 is set as needed considering the length of the transfer material in the direction of transport or the like. A toner film 98 is formed on the surface of the transfer material 97. The first fixing unit 81 is provided with a first heating roller 83 and a first pressure roller 84. The second fixing unit 82 is provided with a second heating roller 85 and a second pressure roller 86. The transfer material 97 heated by the first heating roller 83 of the first fixing unit 81 is reheated by the heating roller 85 of the second fixing unit 82.

The first heating roller 83 includes a mold release layer 83*b* such as fluorine contained resin on the outer surface of a metal roller (hereinafter, referred to as core metal) 83*a* which functions as a core metal. A heater lamp 87*a* (electric heat source) is provided in the interior of the core metal 83*a*. The first pressure roller 84 includes a elastic layer 84*b* such as silicone rubber on the outer periphery of the core metal 84*a*, and a mold release layer 84*c* such as the fluorine contained resin on the outer surface of the elastic layer 84*b*. The mold release layer 83*b* provided on the core metal 83*a* of the first heating roller 83 is formed by coating with fluorine contained resin or covering with a fluorine contained resin tube.

The second heating roller 85 includes a elastic layer 85*b* such as silicone rubber on the outer periphery of the core metal 85*a* and a mold release layer 85*c* such as the fluorine contained resin on the outer surface of the elastic layer 85*b*. The mold release layer 85*c* provided on the elastic layer 85*b* of the second heating roller 85 is formed by coating with the fluorine contained resin or covering with the fluorine contained resin tube. The heater lamp 87*c* is provided in the interior of the core metal 85*a*. The second pressure roller 86 includes a elastic layer 86*b* such as silicone rubber on the outer periphery of a core metal 86*a* and a mold release layer 86*c* such as the fluorine contained resin on the outer surface of the elastic layer 86*b*. The heater lamps 87*a* and 87*c* provided in the first heating roller 83 and the second heating roller 85 are connected to a controller and are controlled in temperature. Heater lamps 87*b* and 87*d* provided in the first heating roller 83 and the second heating roller 85 are connected to a power source.

The core metals, the elastic layers, the materials, the thicknesses, and the diameters of the mold release layers of the heating rollers and the pressure rollers used in the fixing device 80 shown in FIG. 1 are described.

First heating roller 83 of First fixing unit 81; diameter ϕ60 mm

Thickness t of core metal 83*a*=2 mm, Material of core metal 83*a* is AL, and iron, stainless steel, brass, etc. are also usable as the material.

Thickness t of mold release layer 83*b*=30 μm, Material of mold release layer 83*b* is PFA, and PTFE (polytetrafluoroethylene), FEP, ETFE, etc. as the fluorine contained resin are also usable as the material.

First pressure roller 84 of First fixing unit 81; diameter ϕ60 mm

Thickness t of core metal 84*a*=2 mm, Material is AL, and iron, stainless steel, brass, etc. are also usable as the material.

Thickness t of elastic layer 84*b*=2 mm, Material is silicon rubber, and fluorine rubber, urethane rubber, etc. are also usable as the material.

Thickness t of mold release layer 84*c*=30 μm, Material is PFA, and PTFE, FEP, ETFE, etc. are also usable as the material.

Second heating roller 85 of Second fixing unit 82; diameter ϕ60 mm

Thickness t of core metal 85*a*=2 mm, Material is AL, and iron, stainless steel, brass, etc. are also usable as the material.

Thickness t of elastic layer 85*b*=2 mm, Material is silicon rubber, and fluorine rubber, urethane rubber, etc. are also usable as the material.

Thickness t of mold release layer 85*c*=30 μm, Material is PFA, and PTFE, FEP, ETFE, etc. are also usable as the material.

Second pressure roller 86 of Second fixing unit 82; diameter ϕ60 mm

Thickness t of core metal 86*a*=2 mm, Material is AL, and iron, stainless steel, brass, etc. are also usable as the material.

Thickness t of elastic layer 86*b*=2 mm, Material is silicon rubber, and fluorine rubber, urethane rubber, etc. are also usable as the material.

Thickness t of mold release layer 86*c*=30 μm, Material is PFA, and PTFE, FEP, ETFE, etc. are also usable as the material.

As shown in FIG. 1, in the embodiment of the invention, the first heating roller 83 of the first fixing unit 81 includes the mold release layer 83*b* such as the fluorine contained resin on the outer surface of the core metal 83*a*, and is not configured like the second heating roller 85 in which the elastic layer 85*b* such as silicon rubber is provided on the outer periphery of the core metal 85*a*. An example in which the toner film is desirably formed on the surface of the transfer material in this configuration will be described on the basis of explanatory drawings FIGS. 5A to 5D. The explanatory drawings FIGS. 5A to 5D correspond to explanatory drawings in the related art shown in FIGS. 9A to 9D.

Figure 5A:
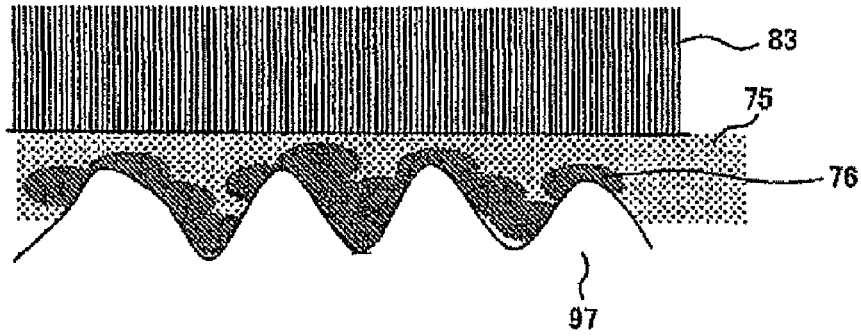
FIGS. 5A to 5D are explanatory drawings showing the embodiment of the invention.
Figure 5B:
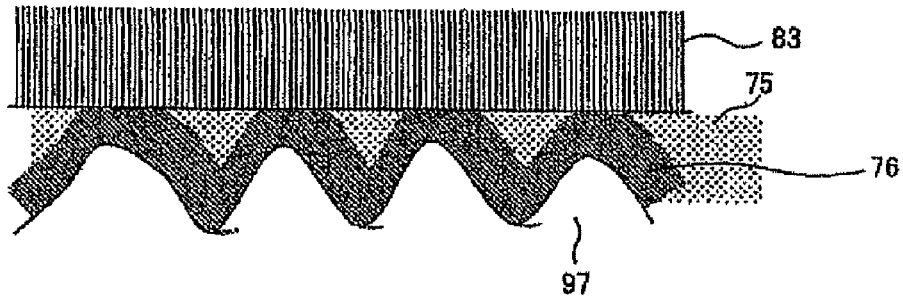

FIG. 5A and FIG. 5B show states of the toner in the first fixing unit on the upstream side in terms of the direction of transport of the transfer material. The heating roller 83 includes the mold release layer 83*b* such as the fluorine contained resin on the outer surface of the core metal 83*a* as described in FIG. 1. In FIG. 5A, since the elastic material such as silicon rubber is not provided on the outer surface of the core metal 83*a*, the coefficient of thermal conductivity of the heating roller 83 is high, and the heating roller 83 is heated at a blast by a halogen lamp, so that the aggregation of the melted solid content 76 is sufficiently achieved. Therefore, the carrier 75 is pushed out by the aggregated solid content 76, so that the carrier 75 is floated out on the surface layer of the transfer material 97. In FIG. 5B, the solid content 76 forms a layer separately from the carrier 75. The carrier 75 is accumulated in toughs of the solid content 76.

Figure 5C:
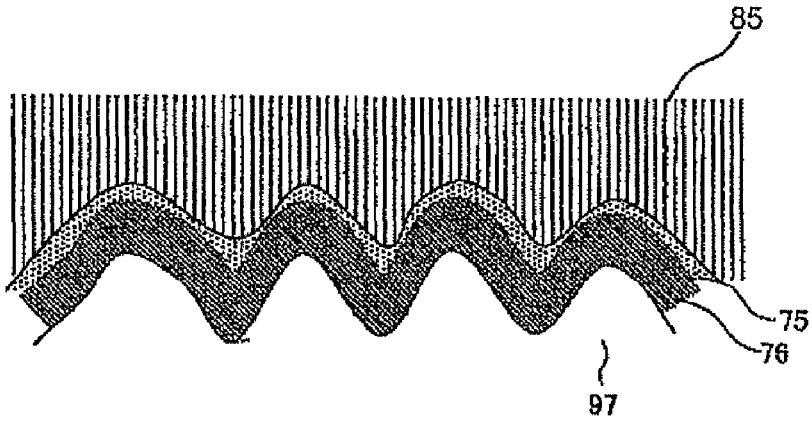
Figure 5D:
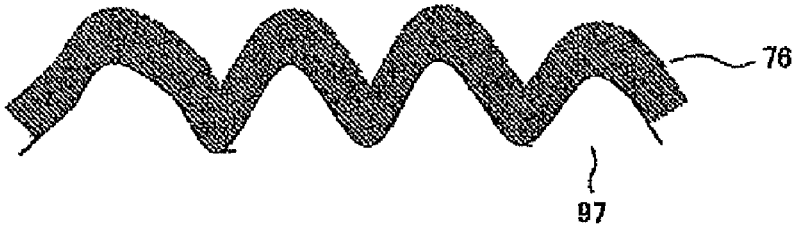

FIG. 5C shows a state of the toner in the second fixing unit. In FIG. 5C, since the elastic material is provided on the heating roller 85, a uniform pressure is applied on the toner, and the carrier stored in carrier traps is pushed out and a uniform film is formed thereon. Therefore, in FIG. 5D, a state in which the toner film is formed along pits and projections on the surface of the transfer material is shown.

In this manner, in the embodiment of the invention, since the metallic roller having a good thermal conductivity because it does not have the elastic layer is used in the first fixing unit as shown in FIG. 1, the aggregation of the toner solid content is achieved quickly, so that the separation between the solid content and the carrier of the toner occurs. After the separation between the solid content and the carrier of the toner occurs, by employing the metallic roller having a low hardness because of the elastic layer provided thereon in the second fixing unit, the surface pressure applied on the respective portions of the transfer material is uniformized. Therefore, a film is formed along the roughness of the surface layer of the transfer material, whereby a preferable image having a small gloss difference is obtained by a toner coating portion and the transfer material by themselves.

Figure 2:
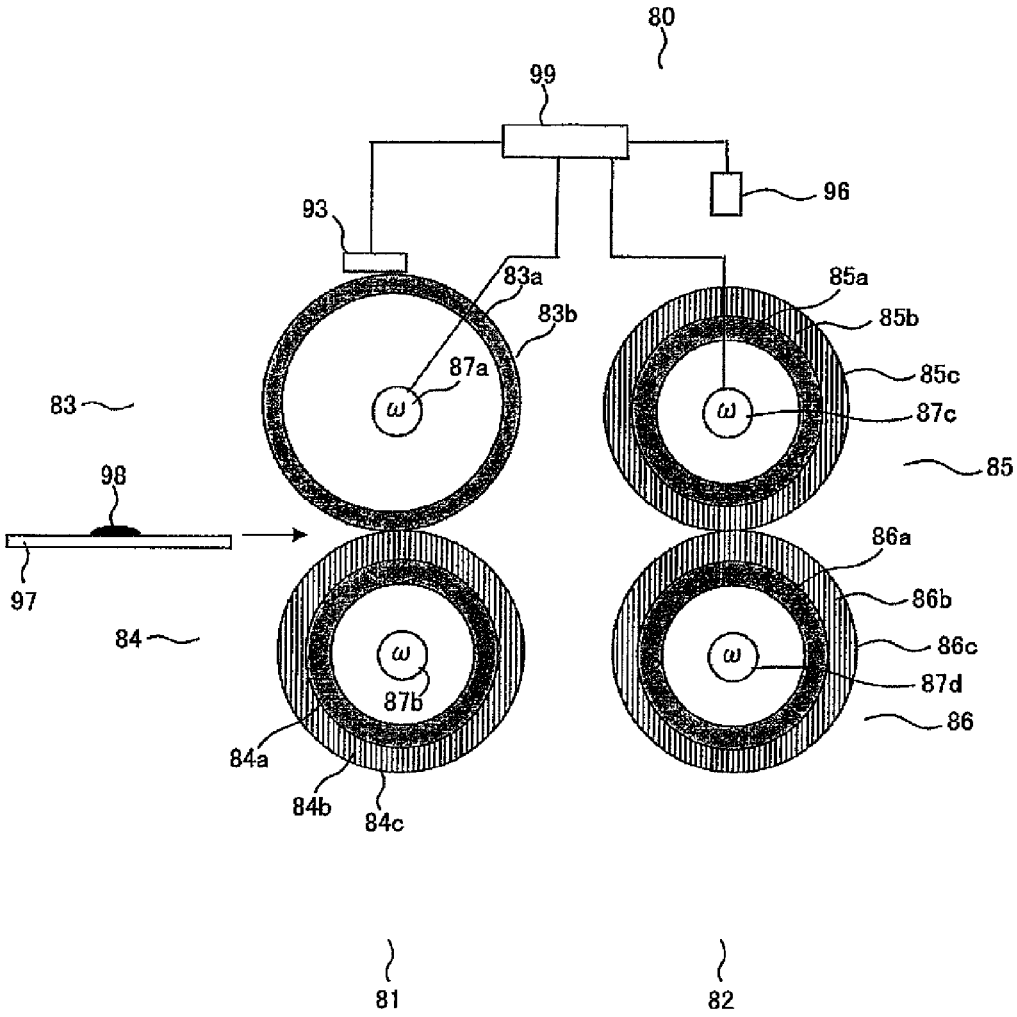
FIG. 2 is an explanatory drawing showing another embodiment of the invention.

FIG. 2 is an explanatory drawing showing another embodiment of the invention. The like elements are designated by the same numbers as in FIG. 1 and a detailed description is omitted. The fixing device 80 in FIG. 2 includes a first temperature sensing member 93 and a second temperature sensing member 96 configured to sense temperatures of the first heating roller 83 of the first fixing unit 81 and the second heating roller 85 of the second fixing unit 82, respectively. The first temperature sensing member 93 and the second temperature sensing member 96 are connected to a controller 99 together with the first heating roller 83 and the second heating roller 85. The controller 99 controls the temperatures of the first heating roller 83 and the second heating roller 85 on the basis of the sensed temperatures of the first temperature sensing member 93 and the second temperature sensing member 96.

Figure 3:
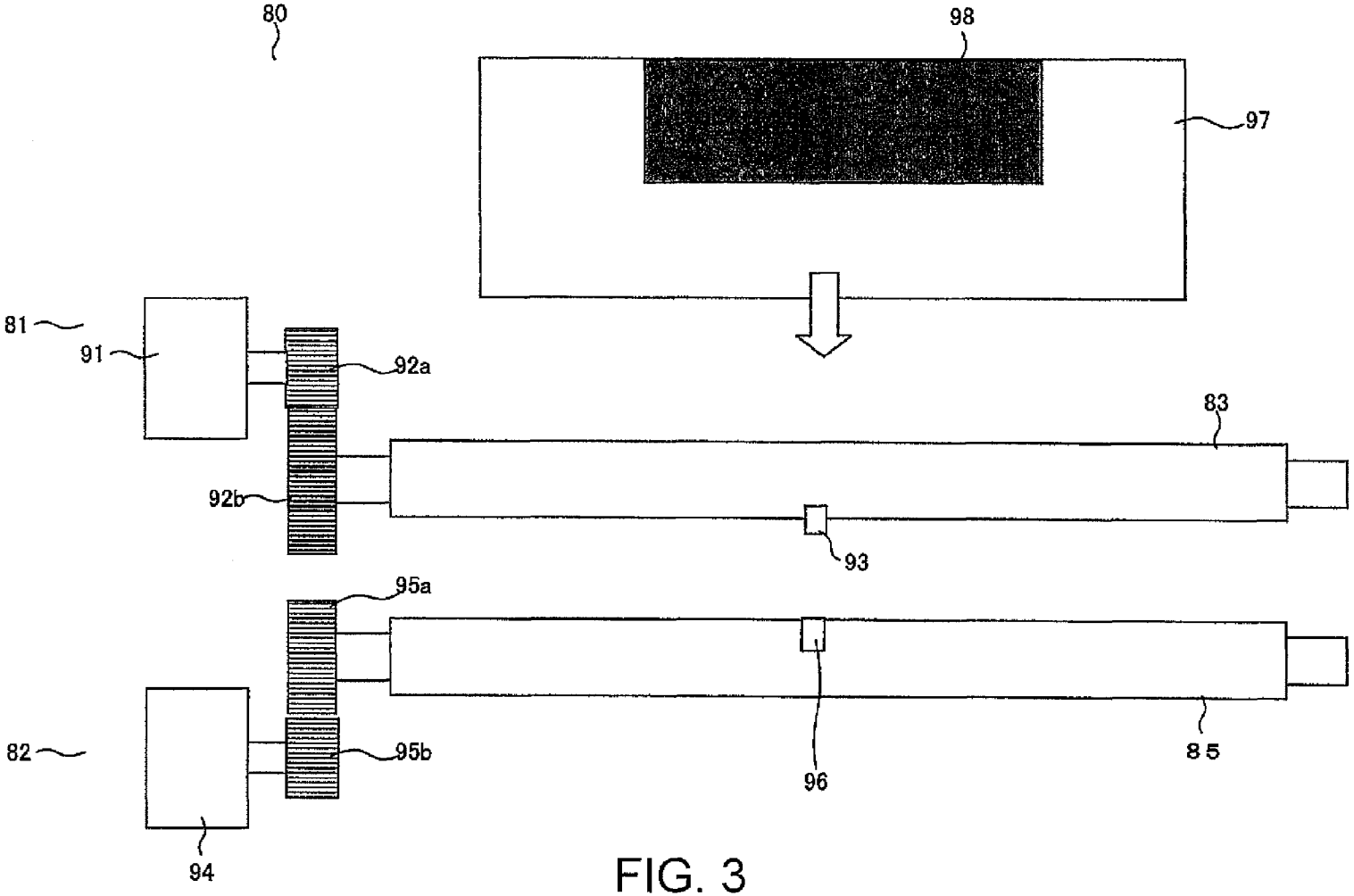
FIG. 3 is an explanatory drawing showing the another embodiment of the invention.

The first temperature sensing member 93 is provided so as to be in contact with the first heating roller 83, and the second temperature sensing member 96 is provided so as to be out of contact with the second heating roller 85. The second temperature sensing member 96 is provided within a range of the width on the heating roller where the transfer material (recording paper) passes as shown in FIG. 3. In the embodiment shown in FIG. 2, a contact-type thermistor may be used as the temperature sensing member 93, and a thermopile-type temperature sensor may be used as the temperature sensing member 96.

FIG. 3 is a schematic plan view of the fixing device 80 shown in FIG. 2 viewed from above. The toner film 98 is formed on the transfer material 97 except for both end portions. Reference numerals 91 and 94 designate drive motors, and reference numerals 92*a*, 92*b*, 95*a*, and 95*b* designate claw gears. The drive force of the drive motor 91 is transmitted to the first heating roller 83 via the claw gears 92*a* and 92*b*. The drive force of the drive motor 94 is transmitted to the second heating roller 85 via the claw gears 95*a* and 95*b*. The first temperature sensing member 93 and the second temperature sensing member 96 are disposed at or near an axial center of the heating roller. Therefore, the temperatures of the first heating roller 83 and the second heating roller 85 in the axial direction are sensed averagely without deviating to one end, so that the temperature control of the first heating roller 83 and the second heating roller 85 is achieved precisely.

In the embodiment shown in FIG. 2 and FIG. 3, the first heating roller 83 having no elastic layer employs the contact-type temperature sensing member 93. In such a case, since there is no remarkable damage onto the surface layer of the first heating roller 83, the low-cost contact-type temperature sensing unit may be used, so that elongation of the lifetime of the fixing device is enabled without increasing the cost. Also, by using the non-contact temperature sensing member 96 as the second heating roller 85 having the elastic layer, the surface layer of the second heating roller 85 is prevented from being formed with flaws, so that the deterioration of the image quality is effectively avoided.

Figure 4:
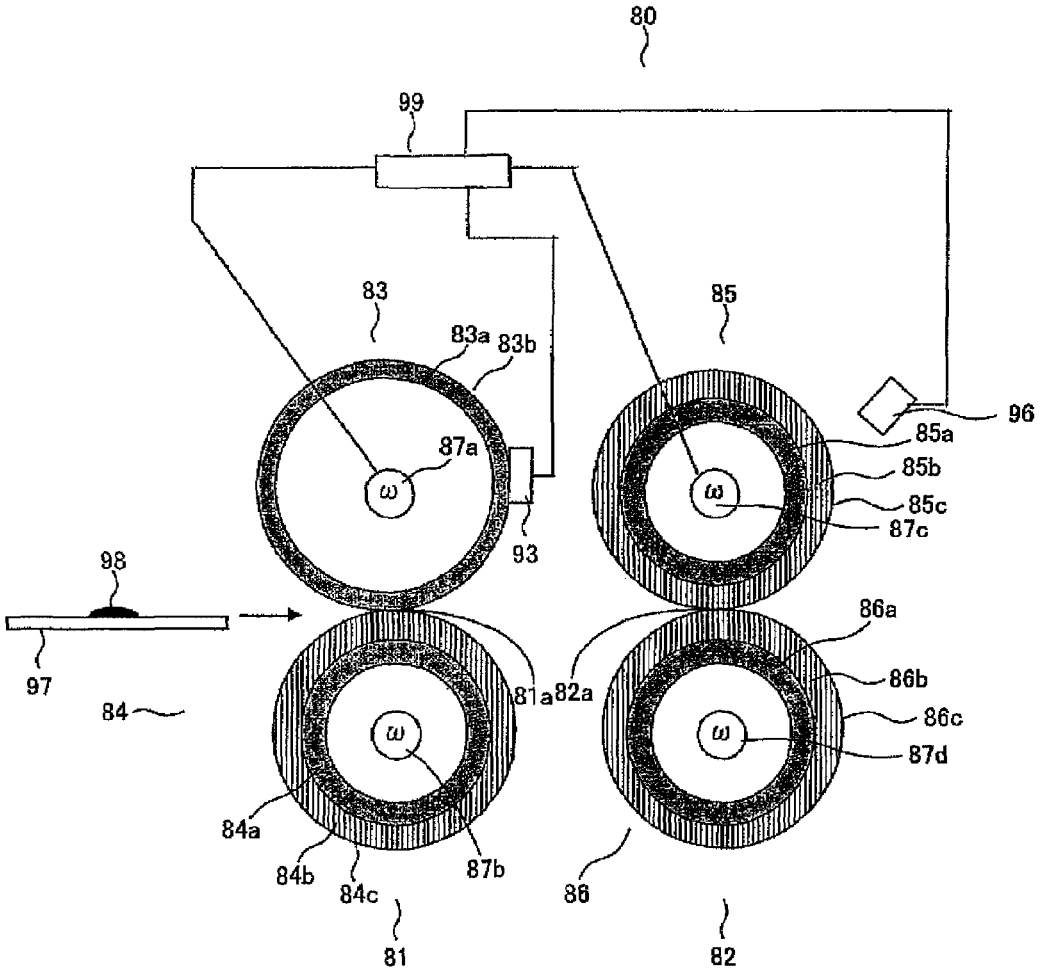
FIG. 4 is an explanatory drawing showing a still another embodiment of the invention.

FIG. 4 is an explanatory drawing showing still another embodiment of the invention. The like elements are designated by the same numbers as in FIG. 2 and a detailed description is omitted. In FIG. 4, the positions of arrangement of the temperature sensing members 93 and 96 are different from those in FIG. 2. The temperature sensing member 93 is provided on the exit side of a nip portion (position of abutment between the heating roller 83 and the pressure roller 84) 81*a* of the first fixing unit 81 when viewed in terms of the direction of transport of the transfer material 97. The temperature sensing member 96 is provided on the exit side of a nip portion (position of abutment between the heating roller 85 and the pressure roller 8) 82*a* of the second fixing unit 82 when viewed in terms of the direction of transport of the transfer material 97.

In the embodiment shown in FIG. 4, the positions of arrangement of the temperature sensing members 93 and 96 are set to the exit sides of the nip portions 81*a* and 82*a* of the first fixing unit 81 and the second fixing unit 82, respectively. Therefore, temperature drops of the surfaces of the first heating roller 83 and the second heating roller 85 are immediately sensed when the transfer material (recording paper) passes through the respective nip portions 81*a* and 82*a*. Therefore, control of the surface temperatures of the first heating roller 83 and the second heating roller 85 is achieved quickly.

Although the fixing device and the image forming apparatus in which the deterioration of the image quality is restrained in the invention have been described on the basis of the principles and the embodiments, the invention is not limited to these embodiments and various modifications may be made.

What is claimed is:

1. A fixing device that fixes an image developed by liquid developer containing toner and a carrier on a transfer material comprising:

a first fixing unit including:

a first heating roller having a metallic roller, a heater in an interior of the metallic roller, and a resin layer formed directly on the metallic roller and that contacts the image on the transfer material, and a first pressure roller coming into abutment with the first heating roller; and a second fixing unit having:

a second heating roller that contacts and heats the image on the transfer material heated by the first fixing unit and including a metallic roller, a heater in an interior of the metallic roller, an elastic layer formed on the metallic roller, and a resin layer formed on the elastic layer, and a second pressure roller coming into abutment with the second heating roller.

2. The fixing device according to claim 1, comprising:

a first temperature sensing unit coming into contact with the first heating roller; and a second temperature sensing unit disposed so as to be out of contact with the second heating roller.

3. The fixing device according to claim 2, wherein the first temperature sensing unit is provided on the downstream side of an abutting portion between the first heating roller and the first pressure roller in terms of the direction of transport of the transfer material, and the second temperature sensing unit is provided on the downstream side of an abutting portion between the second heating roller and the second pressure roller in terms of the direction of transport of the transfer material.

4. The fixing device according to claim 2, wherein the first temperature sensing unit is provided at or near an axial center of the first heating roller, and the second temperature sensing unit is provided at or near an axial center of the second heating roller.

5. The fixing device according to claim 2, comprising:

a first heat source disposed in the first heating roller;

a second heat source disposed in the second heating roller; and a temperature control unit configured to control the temperatures of the first heat source and the second heat source on the basis of information sensed by the first temperature sensing unit and information sensed by the second temperature sensing unit.

6. An image forming apparatus comprising:

an image carrier;

an exposure unit configured to form a latent image on the image carrier;

a developing unit configured to develop the latent image formed by the exposure unit by liquid developer that contains toner and a carrier;

a transfer member to which an image developed on the image carrier is transferred;

a transfer unit configured to transfer the image transferred on the transfer member to the transfer material;

a first fixing unit including:

a first heating roller having a metallic roller, a heater in an interior of the metallic roller, and a resin layer formed directly on the metallic roller and that contacts the image on the transfer material, and a first pressure roller coming into abutment with the first heating roller; and a second fixing unit having:

a second heating roller that contacts and heats the image on the transfer material heated by the first fixing unit and including a metallic roller, a heater in an interior of the metallic roller, an elastic layer formed on the metallic roller, and a resin layer formed on the elastic layer, and a second pressure roller coming into abutment with the second heating roller.

* * * * *